US007429197B2

(12) United States Patent
Weis et al.

(10) Patent No.: US 7,429,197 B2
(45) Date of Patent: Sep. 30, 2008

(54) 30-PIN CONNECTOR

(75) Inventors: Jarret Weis, San Francisco, CA (US); F. David LaRiviere, Monterey, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 0 days.

(21) Appl. No.: 11/555,179

(22) Filed: Oct. 31, 2006

(65) Prior Publication Data

US 2008/0102685 A1 May 1, 2008

(51) Int. Cl.
*H01R 13/648* (2006.01)

(52) U.S. Cl. ..... 439/680; 439/374

(58) Field of Classification Search ..... 439/680, 439/374

See application file for complete search history.

(56) References Cited

U.S. PATENT DOCUMENTS

| | | | | |
|---|---|---|---|---|
| 5,281,169 | A * | 1/1994 | Kiat et al. | 439/607 |
| 5,660,558 | A * | 8/1997 | Osanai et al. | 439/353 |
| 5,772,471 | A * | 6/1998 | Buck | 439/607 |
| 6,358,089 | B1 * | 3/2002 | Kuroda et al. | 439/607 |
| 6,776,660 | B1 * | 8/2004 | Kubota et al. | 439/609 |

* cited by examiner

*Primary Examiner*—Gary F. Paumen
(74) *Attorney, Agent, or Firm*—LaRiviere, Grubman & Payne, LLP

(57) ABSTRACT

An easily manufactured miniaturized connector in which a shoulder formed on each side of the plug portion cooperates with a cooperating sidewall bearing surface on each side of a recess in the receiver portion so that alignment of the plug with the receiver is automatically achieved as the plug is inserted into the receiver, thereby minimizing misalignment of terminals in the plug and receiver.

17 Claims, 4 Drawing Sheets

30-PIN CONNECTOR

FIELD OF INVENTION

The present invention relates to connectors used for making a connection between two electronic devices, more particularly to connectors having a plethora of terminals for making multiple simultaneous connections, and even more particularly to miniaturized connectors having multiple terminals for connecting together elements of miniaturized electronic devices.

DESCRIPTION OF RELATED ART

It is common in the field of electronic devices to fabricate components that are separable from other components and functionally joined together by connectors having at least two portions, commonly referred to as a plug portion and a receiver portion. The plug, or male, portion is insertable into the receiver, or female, portion in such a way to make contact between terminals, or pins, carried in the plug with terminals or sockets provided in the receiver. Such connections may occur, for example, between circuit boards and components, or between cables and components or other cables.

When the plug is inserted into a receiver, it is essential for the proper working of the associated devices to have each pin align with the specific socket intended for the connection. Yoshida, U.S. Pat. No. 4,741,708; Kiat et al., U.S. Pat. No. 5,281,169; Osani et al., U.S. Pat. No. 5,660,558; and Buck, U.S. Pat. No. 5,772,471, for example, all address multiple-pin connector alignment requirements. While the proper alignment of pins with sockets was not a significant problem when connectors and pins were relatively bulky and pins were surrounded by thicker insulation or separated by greater distances, as connectors became smaller and smaller, pin and socket alignment became both more difficult and critical. Miniaturized connectors are especially vulnerable to misalignment problems which could easily lead to device failures.

Currently, miniaturized connectors commonly use some form of guidance feature to assist the user in achieving correct pin and socket alignment when mating the two connector portions. See for example Kuroda et al., U.S. Pat. No. 6,358,089 B1, wherein parallel grooves 7 and guide ribs 28 are formed on the connector portions. The grooves and ribs are precisely aligned so that a rib closely fits into a groove to maintain the plug-receiver alignment. Similarly, Kubota et al., U.S. Pat. No. 6,776,660 B1, teaches engagement projections 30 that cooperate with engagement slits 50 to assist in maintaining proper alignment when the two portions of the connector are engaged.

These approaches taught by Kuroda et al. and Kuboda et al. to facilitating pin alignment during joining of the connector portions have, however, two deficiencies; they add a level of complexity to the manufacture of the portions (e.g. milling of slits or grooves and the need for precise alignment of projections and slits or grooves) and the ribs or projections are subject to deformation or wear during repetitive matings of the two connector portions, thereby losing the necessary precision. Further, neither Kuroda et al. nor Kubota et al. teach or suggest that such cooperating guidance features should extend for the entire length of a connector plug tongue. What is needed is a simpler manufacturing process leading to a more durable connector with improved alignment accuracy.

SUMMARY OF THE INVENTION

Accordingly, the preferred embodiment of the present invention is an easily manufactured miniaturized connector having two elements or portions in which the sidewall of a shoulder formed on each side of the plug portion cooperates with a sidewall on each side of the receiver portion so that alignment of the plug with the receiver is automatically achieved as the plug is inserted into the receiver, thereby providing precise alignment of the pins with their respective sockets.

The plug is manufactured with a first surface of a tongue or protrusion which is slightly shorter than a second surface of the protrusion and separated therefrom by a thickness. The difference in lengths allows the formation of a shoulder along the entire edge in each edge of the protrusion. The shoulders provide durable guidance sidewall surfaces that are easily incorporated into the manufacturing process. The two surfaces are separated by a thickness which provides space for a number of pins (terminals), commonly 30 but conceivably more or less, each surrounded by an insulation layer to provide isolation between the pins. The plug may cooperate with a variety of suitably dimensioned receivers, or with a specifically manufactured receiver, such as receptacle 20 of U.S. Pat. No. 6,776,660 B1, which is incorporated into the iPOD digital music and video file player manufactured by Apple Computers, Inc.

The receiver is manufactured with a recess sized to closely accept the protrusion of the plug. The recess is of a depth sufficient to guide and protect the plug protrusion as it is fully inserted therein, resulting in physical connection of each pin with its associated socket. In a first embodiment of the connector, the sidewalls of the recess are formed with shoulders which cooperate with the edge shoulders of the plug protrusion, thereby providing for proper alignment of the pins prior to their contact with the receiver terminals or sockets. In a second embodiment of the connector, the sidewalls of the recess are smooth and cooperate with the edges of the wider second surface of the plug protrusion, thereby also providing for proper alignment of the pins prior to their contact with the receiver terminals or sockets.

BRIEF DESCRIPTION OF THE DRAWINGS

For a better understanding of the present invention, reference is made to the below-referenced accompanying Drawing. Reference numbers refer to the same or equivalent parts of the present invention throughout the several figures of the Drawing.

DETAILED DESCRIPTION OF SELECTED EMBODIMENTS

Figure 1A:
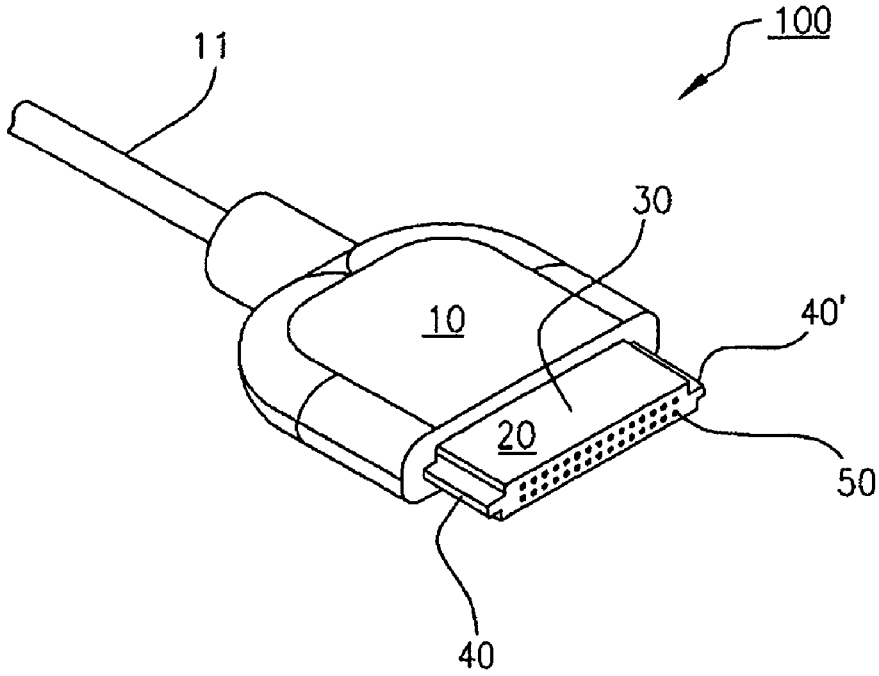
FIG. 1A is a perspective view of an exemplary plug embodiment of the present invention.
Figure 3:
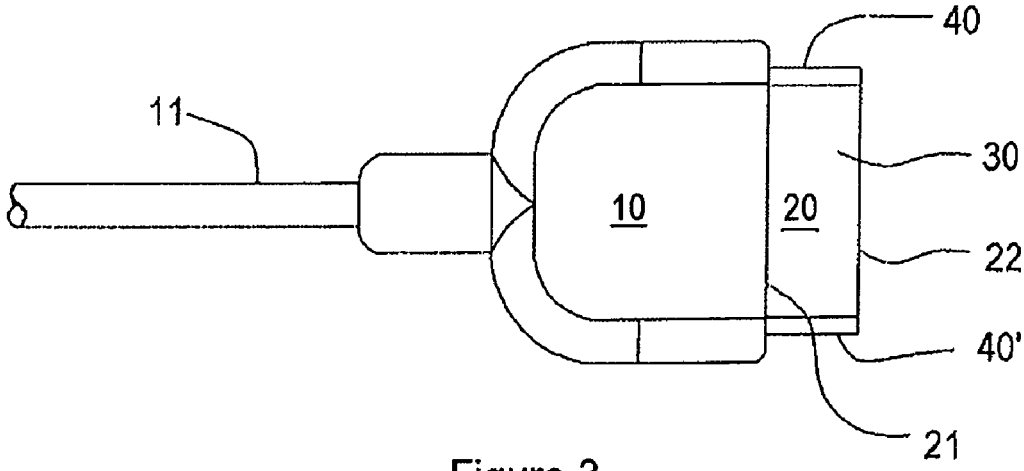
FIG. 3 is a top view of the plug embodiment of FIG. 1.
Figure 4:
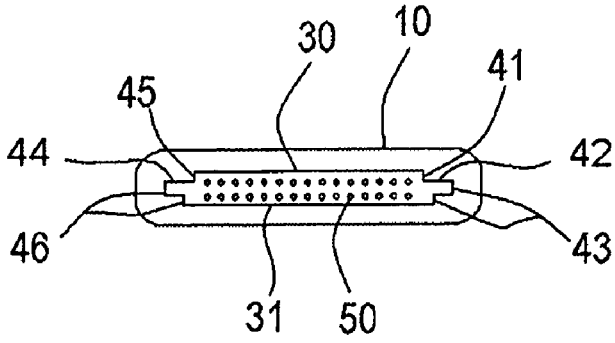
FIG. 4 is an end view of the plug embodiment of FIG. 1.

Referring now to FIGS. 1A, 3, and 4, a first exemplary embodiment of a connector plug 100 according to the present invention is shown. Cable 11 represents cooperation with another device such as a cable to a device or a physical connection to a component for connection with another component. It is to be further understood for the purposes of this application that the plug may be an integral part of a component to be installed on a circuit board which would then contain the receiver element.

Body 10 may be formed of any suitable material, preferably plastic but metal may also be suitable. Body 10 and tongue or protrusion 20 may be of the same material or of different materials. Plug 100 preferably comprises a relatively flat box shape but other shapes are contemplated by the present invention. The exterior of the plug may take any convenient shape, having, for example, smooth surfaces, stippling, checkering, or recesses in any combination to facilitate grasping the plug or receiver by a user, or to provide for unique identification such as distinction between types of devices.

Protrusion 20 extends beyond plug body 10 a length suitable for the dimensions of plug 100. Protrusion 20 extends nominally 60 mm, but may extend as little as 30 mm or as much as 120 mm. A first surface 30 of a protrusion 20 forms one surface of protrusion 20 and defines a width and a length appropriate for the dimensions of plug 100. Shoulder 40 is formed on at least one edge of protrusion 20 for its entire length as explained below.

For convenience within this application, when describing protrusion 20 of plug 100, the term "length" refers to the shorter dimension as shown in the drawing (i.e. the distance between faces 21 and 22) and "width" refers to the longer dimension (i.e. the distance from one shoulder 40 to the directly opposite side of protrusion 20.) The term "thickness" refers to the dimension orthogonal to the length and width. The tern "shoulder", generally shown at 40 and 40' refers to a three dimensional part having surfaces angularly positioned relative to each other, so as to form a step-shaped cross section, as illustrated in FIG. 4 (i.e. the relationship between sidewall 41, surface 42, and sidewall 43).

Pins 50 are encompassed within the thickness of protrusion 20 and may or may not extend beyond protrusion 20. In the preferred embodiment pins 50 are slightly recessed within protrusion 20 for protection against accidental damage of pins 50. In other embodiments pins 50 may be either flush with face 21 or extend slightly beyond. Pins 50 may be of any number, nominally 30 but may be as few as 2 or as many as 64 or more. Pins 50 may be arranged in any pattern; the preferred arrangement being a straight line or linear one, nominally in a single row but two or more rows are also contemplated by the present invention. Pins 50 are parallel to each other, orthogonal to the plane of protrusion 20, and secured in place by insulator material. Pins 50 may be suitable for carrying electrical or optical energy between the plug and receiver.

Figure 1B:
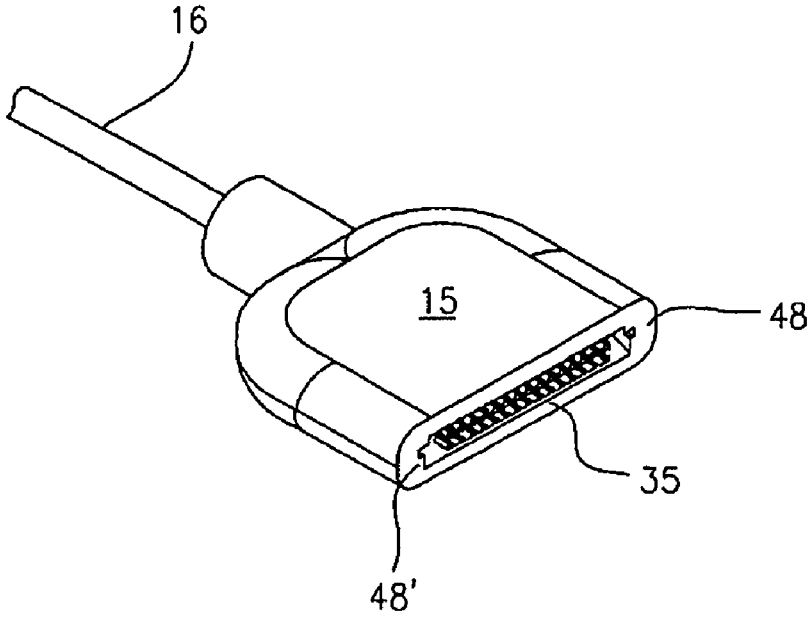
FIG. 1B is a perspective view of an exemplary receiver for the plug of FIG. 1.

Referring to FIG. 1B, an exemplary receiver for the plug 100 of FIG. 1A is shown. Receiver 15 has a recess 35 which is dimensioned to closely cooperate with protrusion 20 of plug 100. Recess 35 has bearing surface sidewalls 48 and 48' which are shaped to cooperate with shoulders 40 and 40' of projection 30. In the preferred embodiment sidewalls 48 and 48' are formed with shoulders to cooperate with shoulders 40 and 40' of plug 100. However, either of sidewalls 48 and 48' may also be smooth. The exterior of the receiver may take any convenient shape, having, for example, smooth surfaces, stippling, checkering, or recesses in any combination to facilitate grasping the plug or receiver by a user, or to provide for unique identification such as distinction between types of devices. Within recess 35 are terminals (not shown) to cooperatively receive pins 50 of plug 100. Cable 16 represents a connecting element to another device, or alternatively, a component of which receiver 15 is an integral piece, for example a circuit board or other electrical component.

Referring now to FIG. 3, a top view of the exemplary plug 100 of FIG. 1 is shown. Protrusion 20 with a first surface 30 has a length that extends beyond face 21 of body 10 to protrusion 20 face 22, a distance in the range of 30 mm to 120 mm, nominally 60 mm. Shoulders 40 and 40' are formed on either edge of protrusion 20 as explained below. Protrusion 20 has a width that extends between shoulders 40 and 40'.

Referring to FIG. 4, an end view of the exemplary plug 100 of FIG. 1 is shown. Preferably surfaces 42 and 44 have equal dimensions, but may be of unequal dimensions if desired. Surfaces 30 and 31 are separated by a thickness, represented by sidewalls 41 and 45, plus sidewalls 43 and 46 respectively. Preferably sidewalls 41 and 45 are of equal height, but may be of different heights if desired. Varying the dimensions of shoulder elements 41-46 provides for physical coding of individual plugs for use in unique receivers, if desired. Additionally, while protrusion 20 is shown as planar, it may also be curved.

Figure 2A:
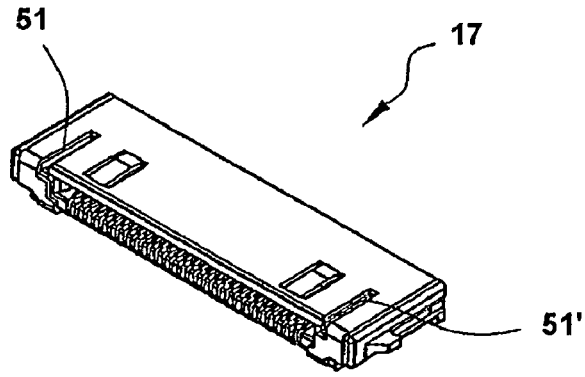
Figure 2A Prior Art
FIG. 2A is a perspective view of a prior art plug.
Figure 2B:
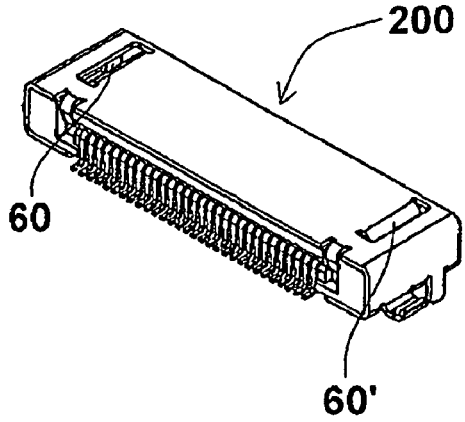
Figure 2B Prior Art
FIG. 2B is a perspective view of a prior art receiver.
Figure 2C:
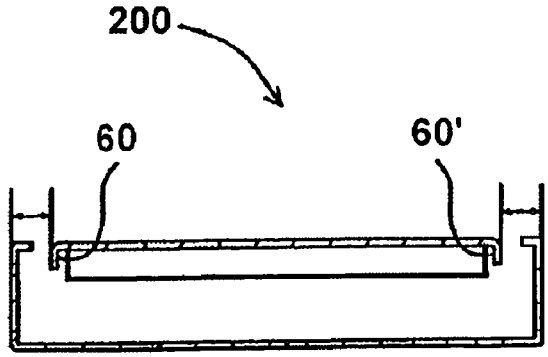
Figure 2C Prior Art
FIG. 2C is a cross section view of a prior art receiver.

Referring to FIGS. 2A, 2B and 2C, a prior art connector system is shown to further demonstrate the versatility and advantage of the present invention. FIG. 2A illustrates a prior art connector plug 17 featuring engagement slits 51 and 51'. FIGS. 2B and 2C show a prior art receiver 200 for the plug 17, in perspective and cross sectional views, respectively. The receiver 200 features engagement projections 60 and 60' extending into the interior of the receiver, that cooperate with the engagement slits 51 and 51' when the plug 17 is inserted into the receiver 200. This cooperation between the engagement projections and engagement slits ensures that the plug is inserted in the correct orientation and guides the insertion process. However, the engagement slits and projections of the prior art connector system add an additional level of complexity to the manufacturing process, thereby rendering the system more costly and difficult to manufacture. Furthermore, the projections are subject to wear during repetitive matings of the two connector portions.

The plug 100 of the present invention is also capable of cooperating with the prior art receiver 200. More specifically, the sidewalls 41 and 45 cooperate with the engagement projections 60 and 60' to ensure proper orientation and guided insertion of the plug. However, unlike the prior art plug 17, no engagement slits are required. The present invention thus provides a simpler and more cost-effective plug that can cooperate with multiple receivers, while promoting correct insertion and precise alignment.

Figure 5:
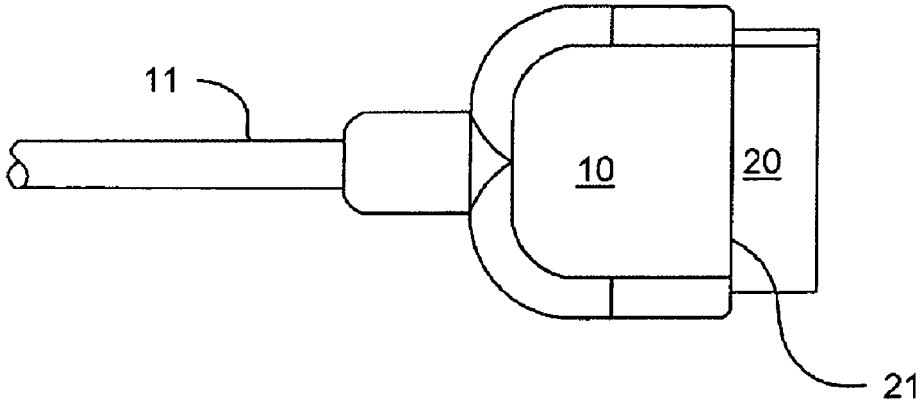
FIG. 5 is a top view of a second plug embodiment of the present invention.
Figure 6:
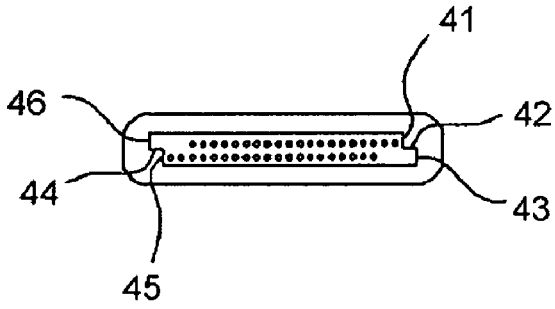
FIG. 6 is an end view of the plug embodiment of FIG. 5.

Referring to FIG. 5 and FIG. 6, an alternative embodiment of plug 100 is shown. Protrusion 20 is nominally equivalent to the preferred embodiment but has shoulders 40 and 40' formed differently. This alternative is useful in an application where reversing plug 100 by rotating it 180 degrees may be acceptable. In such an application, sidewalls 41 and 45 would be equal, while surfaces 42 and 44 and sidewalls 43 and 46 would be equal.

A third embodiment is contemplated but not illustrated. In this embodiment only one end of protrusion 20 would have a shoulder 40 formed thereon. The elements of the single shoulder would be as described above for the preferred embodiment having two shoulders. The corresponding receiver would have one shoulder and one smooth sidewall.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more."

All structural and functional equivalents to the elements of the above-described preferred embodiment and additional embodiments that are known to those of ordinary skill in the art are hereby expressly incorporated by reference and are intended to be encompassed by the present claims. However, it should be readily apparent to those of ordinary skill in the art that various changes and modifications in form, apparatus material, and fabrication material detail maybe made without departing from the spirit and scope of the invention as set forth in the appended claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. No claim herein is to be construed under the provisions of 35 U.S.C. 112, sixth paragraph, unless the element is expressly recited using the phrase "means for."

INDUSTRIAL APPLICABILITY

The present invention applies industrially to miniature connectors for electronic devices. Even more particularly, the present invention applies to miniature connectors for coupling electrical or electro-optical devices together. The present invention is an improvement over known connectors, providing ease of manufacture and improved component life.

What is claimed:

1. A connector comprising:

a first portion with a protrusion having a first planar surface bounded on a first edge by a first shoulder and on a second edge by a second shoulder, the first and second shoulders having sidewalls and having substantially uniform cross section along the entire length thereof, further having a second planar surface bounded by a third and a fourth edge, the second surface being separated from the first surface by a thickness, the thickness encompassing more than one pin; and a second portion having a recess for cooperatively receiving the protrusion and the more than one pin, the recess further having a first bearing surface on a first side and a second bearing surface on a second side of the recess, the bearing surfaces cooperating with the sidewalls of the first and second shoulders to maintain alignment of the first portion.

2. A connector as recited in claim 1 wherein the protrusion has a length within the range of 30 mm to 120 mm.

3. A connector as recited in claim 1 wherein the more than one pin comprises a number of pins within the range of 2 pins to 64 pins.

4. A connector as recited in claim 3 wherein the pins are aligned in at least one row.

5. A connector as in claim 4 wherein the pins convey energy selected from the group consisting of electrical energy and optical energy.

6. A connector as recited in claim 1 wherein the connector is made of at least one material selected from the list of materials comprising metal and polymeric plastic material.

7. A connector having a plurality of first connector pins housed within a first element for engaging projections or other guide surfaces orthogonal to the plane of the first connector pins formed in a second connector element having a plurality of second connector pins housed therein, said first element including first and second shoulders formed at first and second edges thereof respectively, said shoulders including guide sidewalls orthogonal to the plane of the first connector pins for cooperatively engaging the projections or other guide surfaces of the second connector element and having substantially uniform cross section along the entire length thereof.

8. A connector as recited in claim 7 wherein the projection has a width within the range of 30 mm to 120 mm.

9. A connector as recited in claim 8 wherein the plurality of first and second connector pins each comprises a number of pins within the range of 2 pins to 64 pins.

10. A connector as recited in claim 8 wherein the plurality of first and second connector pins each are aligned in at least one row.

11. A connector as in claim 7 wherein the first and second connector pins convey energy selected from the group consisting of electrical energy and optical energy.

12. A connector as recited in claim 11 wherein the connector is made of at least one material selected from the list of materials comprising metal and polymeric plastic material.

13. A connector plug comprising:

a first portion with a protrusion having a first planar surface having a first width bounded by a first edge and a second edge, further having a second planar surface having a second width bounded by a third edge and a fourth edge, the first width being different from the second width, the second surface being separated from the first surface by a thickness, wherein the thickness forms at least one shoulder having substantially uniform cross section along the entire length thereof on at least one edge of the protrusion ; and more than one pin encompassed within the thickness.

14. A connector plug as recited in claim 13 wherein the protrusion has a length within the range of 30 mm to 120 mm.

15. A connector plug as recited in claim 4 wherein the more than one pin comprises a number of pins within the range of 2 pins to 64 pins.

16. A connector plug as recited in claim 15 wherein the pins are aligned in at least one row.

17. A connector plug as recited in claim 16 wherein the plug is made of at least one material selected from the list of materials comprising metal and polymeric plastic material.

* * * * *